US008669204B2

(12) United States Patent
Derennes et al.

(10) Patent No.: US 8,669,204 B2
(45) Date of Patent: Mar. 11, 2014

(54) THERMAL TRANSFER RIBBON INCLUDING A UV-CROSSLINKABLE PROTECTION LAYER

(75) Inventors: Christophe Derennes, Saint Philbert de Grand Lieu (FR); Pierre Guichard, Saint Philbert de Grand Lieu (FR)

(73) Assignee: Armor, Nantes (FR)

( * ) Notice: Subject to any disclaimer, the term of this patent is extended or adjusted under 35 U.S.C. 154(b) by 210 days.

(21) Appl. No.: 13/148,485

(22) PCT Filed: Feb. 2, 2010

(86) PCT No.: PCT/FR2010/050167

§ 371 (c)(1),
(2), (4) Date: Aug. 9, 2011

(87) PCT Pub. No.: WO2010/092277

PCT Pub. Date: Aug. 19, 2010

(65) Prior Publication Data

US 2011/0311739 A1 Dec. 22, 2011

(30) Foreign Application Priority Data

Feb. 16, 2009 (FR) ..... 09 50966

(51) Int. Cl.

| | |
|---|---|
| ***B41M 5/42*** | (2006.01) |
| ***B41M 5/52*** | (2006.01) |
| ***B41M 7/00*** | (2006.01) |

(52) U.S. Cl.

USPC ..... 503/227; 427/152; 428/32.64; 428/32.8

(58) Field of Classification Search

USPC ..... 503/200–227; 428/32.64, 32.8

See application file for complete search history.

(56) References Cited

U.S. PATENT DOCUMENTS

| | | | |
|---|---|---|---|
| 4,950,641 | A | 8/1990 | Hann et al. |
| 5,141,915 | A | 8/1992 | Roenigk et al. |
| 5,866,508 | A | 2/1999 | Sawamura |
| 6,335,307 | B1 | 1/2002 | Imai et al. |
| 2004/0219313 | A1 | 11/2004 | Ieshige et al. |

FOREIGN PATENT DOCUMENTS

| | | |
|---|---|---|
| EP | 0 958 936 | 11/1999 |
| JP | 10 166735 | 6/1998 |

OTHER PUBLICATIONS

International Search Report dated Jun. 21, 2010, corresponding to the PCT application.

*Primary Examiner* — Bruce H Hess
(74) *Attorney, Agent, or Firm* — Young & Thompson

(57) ABSTRACT

A composition for a protection layer for a thermal transfer ribbon which is free of solvents and which contains an acrylate oligomer or polymer having a functionality lower than or equal to 3, a di- or triacrylate monomer and a slip agent which are UV-crosslinkable in the presence of a photoinitiator, capable of forming, after coating on a backing film and after UV crosslinking, a protection layer having a thickness lower than 1 μm. The layer has a good adhesiveness and a low friction coefficient. The composition can particularly be used for the back (5) of a thermal transfer ribbon (1) applied on a surface of the backing film (2), the other surface of the film receiving at least one ink layer (3), while imparting flexibility and thermal and mechanical resistance to the ribbon (1).

16 Claims, 1 Drawing Sheet

THERMAL TRANSFER RIBBON INCLUDING A UV-CROSSLINKABLE PROTECTION LAYER

The present invention relates to the field of thermal transfer printing, and in particular the field of thermal transfer ribbons. More specifically, the invention relates to a composition for a protection layer for a thermal transfer ribbon, to the method for coating said layer and to the protection layer thus obtained, and also to the thermal transfer ribbon including said protection layer.

BACKGROUND OF THE INVENTION

Thermal transfer ribbons generally comprise a backing film, one surface of which is coated with at least one hot-melt ink layer, the opposite surface being most commonly covered with a protection layer called a back.

Conventionally, thermal transfer printing consists in depositing, when the ribbon passes under a print head, by means of the heat provided by heating points (called "resistances" or "dots") of the print head of the printer, the hot-melt ink in the form, for example, of various characters (date, code, number, logo, etc.), on a recipient substrate (paper, cardboard, synthetic film, etc.). The ink of the thermal transfer ribbon is transformed (by fluidification or sublimation) under the effect of the heat, and by simple pressure is transferred in the form of characters onto said recipient substrate.

In order to allow optimum writing quality, in particular according to the speed and temperature constraints exerted by the printer, it is necessary for the back of the ribbon to be able to dissipate the high energy (temperature) supplied by the print head and to withstand the phenomenon of friction and abrasion between said head and the ribbon.

At the current time, ribbons for thermal transfer printing generally consist of three main parts, namely:

- a backing film of small thickness which is conventionally made of a polymer, for example of polyamide or polyester type, such as polyethylene terephthalate (PET), which is in particular bi-oriented;
- one surface of this film is coated with an inked system, i.e. with at least one layer of ink which is hot-meltable for the purpose of being transferred during printing onto a recipient substrate, optionally combined with an adhesion layer and/or a protection layer for said ink layer;
- the other surface of the film is coated with at least one layer called a back intended to protect said film, while at the same time promoting the slip under the print heads.

This very long ink ribbon is rolled up on itself on mandrels. It must be uniform over its entire length and width.

The presence of a "back" protective layer is essential when the backing film is thin. This is because the ribbon must withstand the various mechanical stresses (elongation, traction) in both dimensions.

Moreover, this back must allow thermal conductivity through its thickness in order to transmit the energy, supplied by the print head, to the inked system present on the opposite surface of the film.

Other protective layers can thus be integrated into the thermal transfer ribbon, in particular on the surface bearing the inked system:

- a protective layer can be deposited directly on the backing film and then be covered with the layer of hot-melt ink, such a layer making it possible to protect the ink once printed on the recipient substrate;
- a protective layer can also be deposited on the external surface of the ink layer of the ribbon, this layer making it possible to protect the ribbon, during its storage, against its environment (this is because in particular moisture and high temperatures can cause degradation of the ink layer).

SUMMARY OF THE INVENTION

The present invention focuses more particularly on these protection layers for a thermal transfer ribbon, and in particular on their composition.

Up until now, the formulation of these protective layers, in particular of the backs, involved the presence of aqueous and/or organic solvent(s). It is in fact necessary to have a composition that is sufficiently fluid to allow it to be coated onto the corresponding surface of the polyester backing film. The term "solvent" will be intended to mean, throughout the text, any substance which is used to dilute or to solubilize the constituents of the composition, and which is then removed from the composition by evaporation. The presence of this solvent, which, after coating, must be removed by evaporation during a drying operation, has a certain number of drawbacks, which are listed hereinafter.

It is first of all necessary to adhere to the constraints related to hygiene and safety regulations.

The presence of solvent and optionally of other volatile materials is also incompatible with the setting up of an eco-design approach in the context of a policy of sustainable development which tends to reduce the amounts of starting materials for manufacturing the protective layers and more generally the entire ribbon.

Moreover, the evaporation of the solvent is not always uniform over the entire surface of the ribbon; this results in differences in uniformity within the composition of the back. It should be recalled that these thermal transfer ribbons can have very long lengths, often reaching several tens of kilometers.

Finally, the actual evaporation of this solvent results in a loss of material of the starting composition; it therefore has an economic consequence: the reduction of the solvent fraction in the formulation makes it possible to reduce the cost thereof and to eliminate the considerable losses of starting materials.

In order to solve these problems, solvent-free backs have already been developed; they are compositions of which the constituents are heat-crosslinkable. These crosslinkings, generally carried out at temperatures above 100-120° C., cause shrinking of the backing film at these temperatures. Owing to the bi-oriented nature of the PET film, it is noted in particular that said film shrinks along its width, the ribbon being stretched along its length.

Consequently, the main objective of the present invention is to overcome the above drawbacks relating to the presence of solvent(s) in formulations for the backs of the thermal transfer ribbons.

A first aim of the invention is to propose a composition for a protective layer for such ribbons, for example for backs, which is free of solvents and which makes it possible to prepare backs that are perfectly homogeneous, both along the width and along the length of the ribbon, and without heating the backing film.

It is, however, essential to prepare backs of small thickness, not exceeding the conventional thicknesses of 0.10 to 0.40 μm, so as not to be detrimental to the overall quality of the thermal transfer ribbons thus prepared, in particular so as not to be detrimental to the transferability of the ink, deposited on the other surface, nor to the flexibility of the ribbon, nor to the total thickness of the rolls formed by the rolling up of the ribbons.

It is, in addition, of course necessary to maintain, or even improve, the properties of the thermal transfer ribbon backs, in particular the properties of adhesion to the backing film, of thermomechanical strength, of abrasion resistance, and of maintaining a low friction coefficient, while at the same time retaining good printing quality.

In order to promote the slip of the back of thermal transfer ribbons, many patents recommend the use of back compositions containing high concentrations of silicone-based or siloxane-based polymer(s). The high concentrations of such polymers present a certain number of drawbacks, among which are a lack of adhesion of the back and a high viscosity, and also a high cost. The back composition according to the invention must not therefore contain high concentrations of such polymers.

To this effect, the composition for a protection layer, which is free of solvents, for a thermal transfer ribbon is, according to the invention, characterized in that it contains the following constituents:

a) a mixture of polyether acrylate and of urethane polyacrylate, which are UV-crosslinkable, comprising a functionality at most equal to three, preferably equal to three, b) a diluent for the mixture a) in the form of at least one di- or triacrylate monomer, which is UV-crosslinkable, said monomer preferably having a viscosity of less than or equal to 200 mPa·s, at 25° C., c) a slip agent, in liquid form, at a concentration of less than or equal to 10% by weight of the composition;

the composition being capable of forming, after coating and UV radiation crosslinking in the presence of a photoinitiator d) or electron beam crosslinking, a protection layer having a thickness of less than 1 micrometer.

Surprisingly, it has emerged that the composition according to the present invention imparts advantageous thermomechanical properties to the protection layer when the constituent a) comprises a functionality at most equal to 3, preferably equal to 3, in the presence of the di- or triacrylate monomer constituent b), contrary to the teaching of document EP 0 314 348.

The UV-crosslinkable constituent b) preferably has a viscosity of less than or equal to 200 mPa·s, advantageously less than or equal to 100 mPa·s, in order to serve as a diluent for the constituent a) (if the latter has a viscosity of greater than 1500 or 2000 mPa·s, for example), and also, depending on the nature of the monomer, in order to allow better adhesion of the protection layer on the backing film of the thermal transfer ribbon.

Advantageously, the slip agent is also UV-crosslinkable.

This composition for a protection layer for a thermal transfer ribbon can also contain a spreading agent, an antifoam, an anti-blocking agent, an antistatic agent, a dye and/or a tracer, which are conventional in the thermal transfer field.

However, according to one entirely advantageous embodiment, said composition contains exclusively the constituents a), b) and c) or exclusively the constituents a), b), c) and d), i.e. without any other additive.

It has proved to be the case that, compared with the thermal transfer ribbon back compositions of the prior art, the composition according to the present invention allows very rapid (virtually instantaneous) and complete crosslinking of all the constituents of the back. Specifically, the crosslinking is complete and the properties of the material after radiation are stable as soon as the irradiation zone is exited. Such a crosslinking does not require high temperatures, and the backing film is thus not damaged.

In addition, since this composition is free of solvents, its preparation, in the absence of solvent from one end to the other of the production, eliminates the chemical risks that can be linked in particular to explosions and fire, while at the same time reducing its harmful effects on the environment.

Advantageously, the composition according to the invention contains the following concentrations as percentage by weight, relative to the total composition:

constituent a): from 30 to 85%, preferably from 40 to 75%,
constituent b): up to 60%, preferably from 10 to 50%,
slip agent c): from 0.5 to 10%, preferably from 5 to 10%,
photoinitiator d): from 0 to 7%, preferably from 3 to 7%.

With regard to the constituents b), c) and d), they can be chosen:

for the constituent b), which is a di- or triacrylate monomer acting as an aid to the crosslinking and as reactive diluent, from dipropylene glycol diacrylate (DPGDA), glyceryl propoxylate triacrylate (GPTA), ethoxylated hexanediol diacrylate (HD(EO)3DA), hexanediol diacrylate (HDDA), tripropylene glycol diacrylate (TPGDA), trimethylolpropane triacrylate (TMPTA), pentaerythritol tri- and tetraacrylate (PETIA) or a mixture thereof;

for the constituent c), a slip-promoting agent, from silicone (meth)acrylates, polysiloxane acrylates, in particular siloxane-modified polyethers, such as dimethylpolysiloxane-modified polyether, and fluorinated surfactants, or a mixture thereof;

with regard to the photoinitiator d) which makes it possible to initiate the crosslinking, it can be chosen from benzophenone, 4-chlorobenzophenone, 4,4-dimethoxybenzophenone, acetophenonephenone, 4-methylacetophenone, 2-methoxy-2-phenylacetophenone, dimethylhydroxyacetophenone, 1-hydroxy cyclohexyl phenyl ketone, 2-hydroxy-2-methyl-1-phenylpropan-1-one, 2-hydroxy-1-(4-(4-(2-hydroxy-2-methylpropionyl)benzyl)phenyl)-2-methylpropan-1-one, 1-hydroxy cyclohexyl phenyl ketone, or a mixture thereof.

All these constituents are advantageously in liquid form and the back composition has, after coating, a viscosity at 25° C. of less than or equal to 4000 mPa·s, preferably less than or equal to 2000 mPa·s, more preferably less than 1500 mPa·s. A low viscosity of the composition facilitates very thin coating on the backing film of the thermal transfer ribbon.

Preferably, in the composition according to the present invention, the constituent a) is a mixture of polyether acrylate and of urethane polyacrylate. This is because it has been observed that polyether acrylate provides a better mechanical strength and urethane acrylate increases the flexibility of the back. Advantageously, the composition contains, as percentages by weight, 20 to 60% of polyether acrylate and 20 to 55% of urethane acrylate.

The present invention also relates to the method for coating of such a composition for a protection layer of a thermal transfer ribbon.

To this effect, the method for coating of the composition comprises the step of mixing the constituents a), b) and c) at ambient temperature, optionally in the presence of a photoinitiator, for the purpose of obtaining a liquid composition, and then a step of applying the composition, in a thin layer by means of a multi-roll coater, on a surface of the backing film of said ribbon circulating between two rolls of the coater, and a step of UV irradiation crosslinking or electron beam crosslinking of said layer applied on the backing film in order to constitute a protection layer for a thermal transfer ribbon, said protection layer having a thickness of less than 1 micrometer.

The UV irradiation can take place, for example, under lamps emitting UVA, UVB and/or UVC rays.

Conventionally, the backing film can be pretreated by means of a Corona process, intended in particular to increase the adhesion of said protective layer to the backing film.

The rolls are preferably corotating rolls rotating at a speed of between 30 and 1000 m/min. The coating temperature is generally between 10 and 60° C.

It is thus possible to coat a uniform layer according to a grammage of between 0.05 and 0.30 g/m$^2$, preferably 0.10 to 0.20 g/m$^2$. The uniform thickness of said protection layer is thus between 0.05 μm and 0.4 μm, preferably between 0.10 and 0.25 μm, according to the density of the constituents.

Despite this small thickness, the back of the present invention comprises advantageous properties in terms of the thermomechanical strength and also the friction coefficient of the printer heads on this back, in particular a dynamic friction coefficient kd, measured according to standard ASTM D1894, of less than or equal to 0.300, preferably less than 0.200, or even less than 0.115.

According to a first embodiment of the invention, it is thus possible to produce a thermal transfer ribbon comprising a backing film made of a polymer of polyester type, one surface of said film being coated with at least one layer of ink which is hot-meltable with a view to being transferred during printing, the other surface of said film being coated with a protection layer, called a back, in which the protection layer is as described above.

According to a second embodiment, the thermal transfer ribbon comprises a backing film made of a polymer of polyester type, one surface of said film being coated with at least one layer of ink which is hot-meltable with a view to being transferred during printing, in which the protection layer according to the invention is placed between the backing film and the layer(s) of ink, or partially or totally covers the layer(s) of ink.

According to this second variant, the surface of the backing film opposite the layer(s) of ink can also be covered with a back.

BRIEF DESCRIPTION OF THE DRAWINGS

Other characteristics and advantages of the invention will emerge from the following description of the various embodiments given by way of nonlimiting examples and represented in the attached figures in which.

EXAMPLES OF FORMULATIONS

Figure 1:
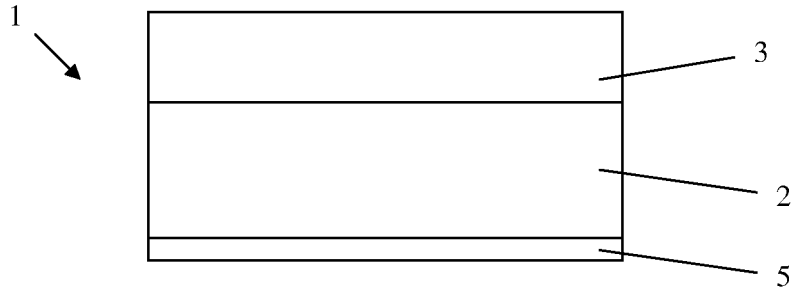
FIG. 1 is a diagram in section of a thermal transfer ribbon according to the first embodiment of the invention.

Unless otherwise indicated, throughout the text, the concentrations are expressed as percentages by weight of the general formulation.

(the left-hand columns indicate the trade names of the constituents used)

Comparative examples 1 to 4 describe compositions for a protection layer containing at least one constituent having a functionality of greater than 4.

Example 1

Comparative

TABLE 1

| Trade name | Chemical name | Amount as % |
|---|---|---|
| Ebecryl 220 | Aromatic urethane acrylate | 21.6 |
| TMPTA | Trimethylolpropane triacrylate | 46.9 |
| Ebecryl 7100 | Amino acrylate | 24.5 |
| Tegorad 2700 | Silicone acrylate | 4.0 |
| PBZ | Benzophenone | 3.0 |

Viscosity at 25° C. = 1020 mPa · s

Example 2

Comparative

TABLE 2

| Trade name | Chemical name | Amount as % |
|---|---|---|
| Ebecryl 220 | Aromatic urethane acrylate | 21.0 |
| TMPTA | Trimethylolpropane triacrylate | 45.4 |
| Ebecryl 7100 | Amino acrylate | 23.7 |
| Tegorad 2700 | Silicone acrylate | 7.0 |
| PBZ | Benzophenone | 3.0 |

Viscosity at 25° C. = 1160 mPa · s

Example 3

Comparative

TABLE 3

| Trade name | Chemical name | Amount as % |
|---|---|---|
| Ebecryl 220 | Aromatic urethane acrylate | 21.6 |
| TMPTA | Trimethylolpropane triacrylate | 46.9 |
| Ebecryl 81 | Polyether amino acrylate | 24.5 |
| Tegorad 2700 | Silicone acrylate | 4.0 |
| PBZ | Benzophenone | 3.0 |

Viscosity at 25° C. = 540 mPa · s

Example 4

Comparative

TABLE 4

| Trade name | Chemical name | Amount as % |
|---|---|---|
| Ebecryl 220 | Aromatic urethane acrylate | 21.6 |
| TMPTA | Trimethylolpropane triacrylate | 46.9 |
| Ebecryl 7100 | Amino acrylate | 24.5 |

TABLE 4-continued

| Trade name | Chemical name | Amount as % |
|---|---|---|
| Ebecryl 1360 | Silicone hexaacrylate | 4.0 |
| PBZ | Benzophenone | 3.0 |

Viscosity at 25° C. = 930 mPa · s

The following examples 5 to 10 describe compositions for a protection layer according to the invention containing constituents a) having functionalities of less than or equal to 4.

Example 5

TABLE 5

| Trade name | Chemical name | Amount as % |
|---|---|---|
| Genomer 3414 | Polyether acrylate | 37.0 |
| Genomer 1122 | Aliphatic acrylic urethane | 37.0 |
| Miramer M202 | Ethoxylated hexanediol diacrylate | 14.0 |
| Genocure DMHA | Dimethylhydroxyacetophenone | 5.0 |
| Tegorad 2700 | Silicone acrylate | 7.0 |

Viscosity at 25° C. = 270 mPa · s

Example 6

TABLE 6

| Trade name | Chemical name | Amount as % |
|---|---|---|
| Genomer 3414 | Polyether acrylate | 37.0 |
| Genomer 1122 | Aliphatic acrylic urethane | 37.0 |
| Miramer M202 | Ethoxylated hexanediol diacrylate | 14.0 |
| Genocure DMHA | Dimethylhydroxyacetophenone | 5.0 |
| Etercure 6225 | Silicone acrylate | 7.0 |

Viscosity at 25° C. = 230 mPa · s

Example 7

TABLE 7

| Trade name | Chemical name | Amount as % |
|---|---|---|
| Genomer 3414 | Polyether acrylate | 37.0 |
| Genomer 1122 | Aliphatic acrylic urethane | 37.0 |
| Miramer M202 | Ethoxylated hexanediol diacrylate | 14.0 |
| Genocure LTM | Photoinitiator mixture | 5.0 |
| Tegorad 2700 | Silicone acrylate | 7.0 |

Viscosity at 25° C. = 300 mPa · s

Example 8

TABLE 8

| Trade name | Chemical name | Amount as % |
|---|---|---|
| Genomer 3414 | Polyether acrylate | 36.0 |
| Genomer 1122 | Aliphatic acrylic urethane | 36.0 |
| Miramer M202 | Ethoxylated hexanediol diacrylate | 14.0 |
| Genocure DMHA | Dimethylhydroxyacetophenone | 5.0 |

TABLE 8-continued

| Trade name | Chemical name | Amount as % |
|---|---|---|
| CN9800 | Silicone acrylate | 7.0 |
| Tegoa Foamex N | Antifoam | 2.0 |

Viscosity at 25° C. = 310 mPa · s

Example 9

TABLE 9

| Trade name | Chemical name | Amount as % |
|---|---|---|
| Ebecryl 83 | Amine-modified polyether acrylate | 36.7 |
| Ebecryl 270 | Aliphatic urethane acrylate resin | 36.7 |
| HDDA | Hexanediol diacrylate | 16.5 |
| Genocure LBC | 1:1 mixture of 1-hydroxy cyclohexyl phenyl ketone and benzophenone | 3.7 |
| Tegorad 2700 | Silicone acrylate | 6.4 |

Viscosity at 25° C. = 850 mPa · s

Example 10

TABLE 10

| Trade name | Chemical name | Amount as % |
|---|---|---|
| Desmolux VP LS 2265 | Unsaturated aliphatic urethane acrylate resin | 15.0 |
| Desmolux VP LS 2299 | Amine-modified unsaturated polyether acrylate resin | 73.0 |
| Genocure DMHA | Dimethylhydroxyacetophenone | 5.0 |
| Tegorad 2700 | Silicone acrylate | 7.0 |

Viscosity at 25° C. = 480 mPa · s

Example 11

TABLE 11

| Trade name | Chemical name | Amount as % |
|---|---|---|
| Desmolux U100 | Unsaturated aliphatic urethane acrylate resin | 40.0 |
| Desmolux VP LS 2299 | Amine-modified unsaturated polyether acrylate resin | 40.0 |
| HDDA | Hexanediol diacrylate | 8.0 |
| Genocure DMHA | Dimethylhydroxyacetophenone | 5.0 |
| Tegorad 2700 | Silicone acrylate | 7.0 |

Viscosity at 25° C. = 1300 mPa · s

Example 12

TABLE 12

| Trade name | Chemical name | Amount as % |
|---|---|---|
| Desmolux VPLS 2266 | Unsaturated aromatic epoxy acrylate | 54.0 |
| Desmolux VP LS 2299 | Amine-modified unsaturated polyether acrylate resin | 30.0 |
| HDDA | Hexanediol diacrylate | 5.0 |

TABLE 12-continued

| Trade name | Chemical name | Amount as % |
|---|---|---|
| Genocure LBC | 1:1 mixture of 1-hydroxy cyclohexyl phenyl ketone and of benzophenone | 4.0 |
| Tegorad 2700 | Silicone acrylate | 7.0 |

Viscosity at 25° C. = 1100 mPa · s

Example 13

TABLE 13

| Trade name | Chemical name | Amount as % |
|---|---|---|
| Ebecryl 160 | Ethoxylated trimethylol-propane triacrylate | 53.0 |
| Ebecryl 270 | Aliphatic urethane acrylate resin | 16.0 |
| Ebecryl 7100 | Amine functional acrylate | 15.0 |
| Tegorad 2700 | Silicone acrylate | 7.0 |
| HDDA | Hexanediol diacrylate | 5.0 |
| Genocure DMHA | Dimethylhydroxyacetophenone | 5.0 |

Viscosity at 25° C. = 300 mPa · s

The functionalities and the viscosity of the various constituents a) and b) used, given by the suppliers, are collated in table 14.

TABLE 14

| Trade name | Number of functionalities | Viscosity at 25° C. (mPa · s) |
|---|---|---|
| Ebecryl 81 | 3 | 100 |
| Ebecryl 83 | 3 | 500 |
| Ebecryl 160 | 3 | 80 |
| Ebecryl 220 | 6 | 28 000 |
| Ebecryl 270 | 2 | 3000 |
| Ebecryl 7100 | — | 900-1500 |
| Genomer 3414 | 4 | 3500-5000 |
| Genomer 1122 | 1 | 30 |
| Miramer M202 | 2 | 20 |
| Desmolux VPLS2265 | 3 | 800 |
| Desmolux VPLS2266 | 3 | 8000 |
| Desmolux VPLS2299 | 3 | 800 |
| Desmolux U100 | 3 | 7000 |
| HDDA | 2 | 10 |

(—): not communicated

The constituents cited in this table are sold respectively by the companies Cytec (Ebecryl), Rahn (Genomer and Miramer) and Bayer (Desmolux).

The compositions were obtained by mixing the various liquid constituents at 25° C. Each composition was coated (as represented on the embodiment of FIG. 1) on one of the surfaces of a backing film 2 made of PET, having a thickness of 4.5 μm, subjected beforehand to a Corona treatment, in a multi-roll coater, and then crosslinked under UV-A, -B and -C lamps (200 to 380 nm).

The opposite surface of the film 2 was coated with a monolayer of wax ink 3 having a grammage of 4 g/m$^2$. The total thickness of the ribbon 1 was 9 μm, and the protection layer, in this case a back 5, was, depending on the formula, between 0.05 and 0.40 μm.

In order to demonstrate the effectiveness of the various formulations above, the following tests were carried out:

Friction Test

This test consists, by means of a dynamometer, in sliding a sample attached to a mobile sled, over another sample (of the same nature) placed on a fixed plate and measuring the dynamic and static friction coefficients thereof. The results relating to the dynamic friction coefficient kd (measured according to standard ASTM D1894) are given in table 15 hereinafter.

Thermomechanical Strength Test

This test consists in evaluating the strength of the print ribbon when the latter passes through the printer (Toshiba reference TEC B572, flat head). The printing is carried out at various speeds (between 25 and 127 mm/s) and at various energy levels.

The results obtained, with their processing conditions, are collated in table 15:

TABLE 15

| Example | kd | Print energy | Print speed | Ribbon quality | Adhesiveness on backing film |
|---|---|---|---|---|---|
| 1 (comparative) | 0.259 | Low | High | Brittle | Poor |
| 2 (comparative) | 0.049 | Medium | Medium | Brittle | Poor |
| 3 (comparative) | 0.369 | Low | High | Brittle | Poor |
| 4 (comparative) | 0.224 | Medium | High | Brittle | Poor |
| 5 | 0.023 | High | Low | Good | Good |
| 6 | 0.034 | High | Low | Good | Good |
| 7 | 0.080 | High | Low | Good | Good |
| 8 | 0.032 | High | Low | Good | Good |
| 9 | 0.086 | High | Low | Good | Good |
| 10 | 0.126 | Medium | Medium | Good | Good |
| 11 | 0.141 | Low | High | Good | Good |
| 12 | 0.176 | Low | High | Good | Good |
| 13 | 0.111 | High | Low | Good | Good |

The ribbons obtained from the compositions of comparative examples 1 to 4 are not in accordance with expectations, both from the point of view of the friction coefficient (too high in comparative examples 1, 3 and 4), and from the point of view of the ribbon quality: this is because the ribbon breaks under certain measurement conditions, mainly because of poor adhesiveness of the protection layer on the backing film.

Conversely, the results of the tests are entirely satisfactory with the backs obtained from the compositions of examples 5 to 13, particularly in terms of adhesiveness of the protective layer, of flexibility of the ribbon, and of the dynamic friction coefficient kd.

Under the conditions mentioned in table 15, an excellent print quality was also noted during printing in particular of identification labels comprising characters, logos and bar codes.

According to another embodiment, the protection layer described above can also be placed at other positions in the thermal transfer ribbon 1.

Figure 2:
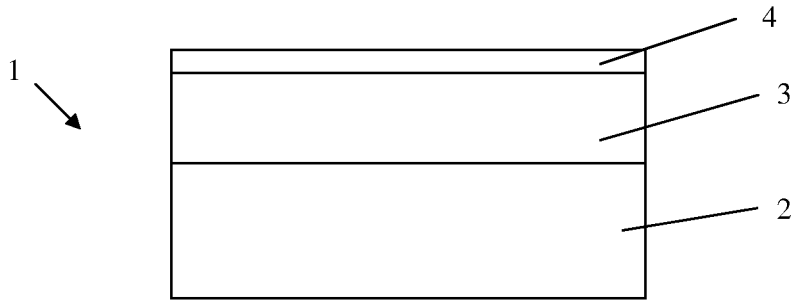
FIGS. 2 and 3 are diagrams in section according to two variants of the second embodiment of the invention.
Figure 3:
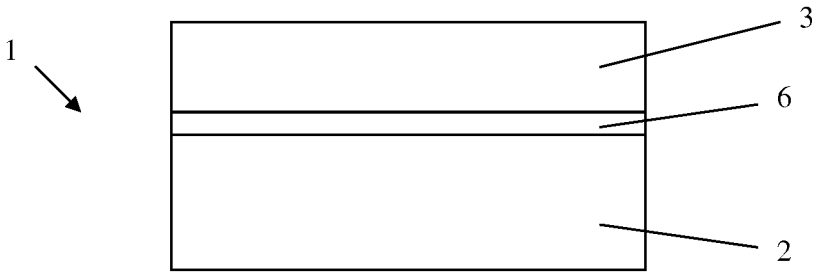

Two variants of this embodiment are represented in FIGS. 2 and 3.

According to one variant represented schematically in FIG. 2, the protection layer covers the inked system containing, in this case, a single layer of ink 3.

As represented in FIG. 3, according to another variant, the protection layer 6 can be applied on the backing film 2 before the coating of the inked system containing, in this case, a single layer of ink 3.

The invention claimed is:

1. A composition for a protection layer, which is free of solvents, for a thermal transfer ribbon, characterized in that it contains the following constituents:

a) a mixture of polyether acrylate and of urethane polyacrylate, which are UV-crosslinkable, comprising a functionality at most equal to three, b) a diluent for the mixture a) in the form of at least one di- or triacrylate monomer, which is UV-crosslinkable, and c) a slip agent, in liquid form, at a concentration of less than or equal to 10% by weight of the composition;

the composition being capable of forming, after coating and UV radiation crosslinking in the presence of a photoinitiator d) or electron beam crosslinking, a protection layer having a thickness of less than 1 micrometer.

2. The composition as claimed in claim 1, characterized in that the slip agent is also UV-crosslinkable.

3. The composition as claimed in claim 2, characterized in that it contains exclusively the constituents a), b) and c) or exclusively the constituents a), b), c) and d).

4. The composition as claimed in claim 1, characterized in that it contains exclusively the constituents a), b) and c) or exclusively the constituents a), b), c) and d).

5. The composition as claimed in claim 1, characterized in that it has a viscosity at 25° C. of less than or equal to 4000 mPa·s.

6. The composition as claimed in claim 5, characterized in that it has a viscosity at 25° C. of less than or equal to 2000 mPa·s, more preferably less than 1500 mPa·s.

7. The composition as claimed in claim 1, characterized in that it contains the following concentrations as percentage by weight, relative to the total composition:

constituent a): from 30 to 85%, constituent b): up to 60%, slip agent c): from 0.5 to 10%, photoinitiator d): from 0 to 7%.

8. The composition as claimed in claim 1, characterized in that it contains, as percentages by weight, from 20 to 60% of polyether acrylate and from 20 to 55% of urethane acrylate.

9. The composition as claimed in claim 1, characterized in that the constituent b) is chosen from hexanediol diacrylate, ethoxylated hexanediol diacrylate and trimethylolpropane triacrylate, or a mixture thereof.

10. The composition as claimed in claim 1, characterized in that the slip agent c) is chosen from silicone (meth)acrylates, siloxane-modified polyethers, polysiloxane acrylates, fluorinated surfactants, or a mixture thereof.

11. The composition as claimed in claim 1, characterized in that the photoinitiator d) is chosen from benzophenone, dimethylhydroxyacetophenone, 1-hydroxy cyclohexyl phenyl ketone, or a mixture thereof.

12. A method for coating of the composition as claimed in claim 1, comprising the step of mixing the constituents a), b) and c) at ambient temperature, optionally in the presence of a photoinitiator, for the purposes of obtaining a liquid composition, and then a step of applying the composition, in a thin layer by means of a multi-roll coater, on one surface of the backing film of said ribbon circulating between two rolls of the coater, and a step of UV irradiation crosslinking or electron beam crosslinking of said layer applied on the backing film in order to constitute a protection layer for a thermal transfer ribbon.

13. A thermal transfer ribbon (1) comprising a backing film (2) made of a polyester polymer, one surface of said film (2) being coated with at least one layer of ink (3) which is hot-meltable with a view to being transferred during printing, the other surface of said film (2) being coated with a protection layer called a back (5), formed according to claim 12.

14. A thermal transfer ribbon (1) comprising a backing film (2) made of a polyester polymer, one surface of said film (2) being coated with at least one layer of ink (3) which is hot-meltable with a view to being transferred during printing, wherein a protection layer (4, 6) formed according to claim 12 is placed between the backing film (2) and the layer(s) of ink (3), or partially or totally covers the layer(s) of ink (3).

15. The composition as claimed in claim 1, wherein the mixture a) of polyether acrylate and of urethane polyacrylate, which are UV-crosslinkable, comprise a functionality equal to three, and wherein said monomer of the diluent b) has a viscosity of less than or equal to 200 mPa·s, at 25° C.

16. The composition as claimed in claim 1, characterized in that it contains the following concentrations as percentage by weight, relative to the total composition:

constituent a): from 40 to 75%, constituent b): from 10 to 50%, slip agent c): from 5 to 10%, photoinitiator d): from 3 to 7%.

* * * * *